US005934456A

United States Patent [19]

Ovadia

[11] Patent Number: 5,934,456

[45] **Date of Patent: *Aug. 10, 1999**

[54] JEWELRY DISPLAY AND STORAGE APPARATUS

[76] Inventor: Joseph Ovadia, 109 Longhill Rd., Little Falls, N.J. 07424

[ * ] Notice: This patent is subject to a terminal disclaimer.

[21] Appl. No.: 08/853,560

[22] Filed: May 8, 1997

[51] Int. Cl.[6] ..... A45C 11/04

[52] U.S. Cl. ..... 206/6.1; 206/566; 211/85.2

[58] Field of Search ..... 206/6.1

[56] References Cited

U.S. PATENT DOCUMENTS

| | | | |
|---|---|---|---|
| D. 303,764 | 10/1989 | Kilmartin, III | D9/423 |
| D. 349,204 | 8/1994 | Lefebvre | D6/476 |
| 4,432,300 | 2/1984 | Lyss | 206/538 |
| 4,432,456 | 2/1984 | Ovadia et al. | 206/566 |
| 4,948,204 | 8/1990 | kilmartin, III | 312/140 |
| 5,033,625 | 7/1991 | Campbell | 206/495 |
| 5,273,153 | 12/1993 | Braun | 206/6.1 |
| 5,323,924 | 6/1994 | Wolff | 206/566 |
| 5,505,294 | 4/1996 | Kilmartin, III | 206/6.1 |
| 5,511,653 | 4/1996 | Ovadia | 206/6.1 |
| 5,540,324 | 7/1996 | Knapp | 206/6.1 |
| 5,649,625 | 7/1997 | Ovadia | 206/6.1 |
| 5,865,306 | 2/1999 | Ovadia | 206/6.1 |

*Primary Examiner*—Paul T. Sewell
*Assistant Examiner*—Jila Mohandesi
*Attorney, Agent, or Firm*—Sofer & Haroun, LLP

[57] ABSTRACT

A jewelry display and storage apparatus having top and bottom frame members is provided. The top frame member defines an open gridwork, the gridwork being formed of a series of openings. The bottom frame member is matingly engageable with the top frame member so that when the top frame member and the bottom frame member are matingly engaged, the top and bottom frame members form a peripheral channel about the perimeter of the frames. One or more jewelry mounting pads are provided for mounting within the openings. The jewelry mounting pads are provided with a top surface upon which jewelry may be mounted and displayed, a bottom surface and peripheral side walls. The bottom surface and a portion of the peripheral side walls are securable within a corresponding opening. An ornamental band having first and second ends is provided so that when the first and second ends of the ornamental band are inserted within a slot in the peripheral channel, the ornamental band is mounted and secured within the channel.

9 Claims, 2 Drawing Sheets

JEWELRY DISPLAY AND STORAGE APPARATUS

FIELD OF THE INVENTION

This invention relates generally to a jewelry display and storage apparatus, and more particularly, to a storage and display device having top and bottom frame members that when engaged define a peripheral channel about the perimeter of the top and bottom frame members, the peripheral channel having a slot adapted to receive first and second ends of an ornamental band so that the ornamental band is mounted and secured within the peripheral channel.

BACKGROUND OF THE INVENTION

Jewelry articles such as earring, pendants and chains can be stored and displayed in a variety of storage devices such as trays, holders or racks. The common type of storage device is a cushioned pad through which the earrings and or pendant posts can be inserted and through which mounting pins can be placed to hold a chain. Other storage and display devices that are in use today are platforms fabricated from wood and covered with cardboard and cushioned vinyl or felt. These platforms are provided with a plurality of tab extensions for retaining the jewelry items. These tab extensions are individually fastened by hand to the cardboard support by a thin wire which is twisted in place. As well, an ornamental band is typically provided about the perimeter of the platform in order to present an aesthetically pleasing display.

Other jewelry display and storage trays are provided with a plurality of openings for receiving jewelry holders. These holders are provided with pads which are normally provided with a peripheral pull tab, and are mounted in a framework or box divided into a series of closed bottom chambers. The peripheral pull tab allows the pad to be removed from the framework for closer inspection by the vendor or potential purchaser.

In order to effect a degree of storage economy, such a framework is often designed to stack upon a similar frame. This is often done by the use of spacer elements or a peripheral downward extending lip. Because the pads are of substantial thickness and are placed in a closed bottomed framework, however, the spacer elements must be of a size that prevents contact between the displayed jewelry and the bottom of the next stacked frame.

This requirement for additional height limits the number of tray frames which may be stacked in a given volume. Further, the use of the peripheral pull tab on the jewelry mounting pad often makes it difficult to remove the pad from the framework as often as insufficient amount of the tab projects upwardly above the frame. Further, the use of such tabs produces a somewhat untidy appearance. Still further the individual pads normally sit within the tray without any means for insuring that they remain affixed therein.

With reference to the aforementioned wood platforms, these platforms do not have the stackability feature as described herein.

As set forth in U.S. Pat. No. 4,432,456, a jewelry display and storage apparatus which is provided with an open grid frame and a plurality of domed jewelry display pads is provided. The walls of the frame and the display pads cooperate to form a mechanism wherein the pads are removably retained within the frame. Mounting means are located on the display pads for securing jewelry items thereto. The mounting means are offset so that a 180 degree rotation of the pad or frame clearance is established between jewelry items and adjacent frame levels when stacked.

However, this reference does not teach or suggest a jewelry display and storage apparatus having top and bottom frame members defining an open gridwork, the bottom frame member being matingly engageable with the top frame member so that when said top frame member and said bottom frame member are matingly engaged, the top and bottom frame members form a peripheral channel about the perimeter of the inter-engaged frames. As well, this reference does not teach or suggest a peripheral channel being provided with a slot for receiving first and second ends of an ornamental band so that when the first and second ends of the ornamental band are inserted within that slot of the channel, the ornamental band is mounted and secured within said channel.

OBJECTS AND SUMMARY OF THE INVENTION

It is therefore an object of the invention to provide a jewelry display and storage apparatus which makes efficient use of available space and that is provided with top and bottom frame members that are matingly engaged.

Another object of the invention is to provide a jewelry display apparatus in which individual jewelry mounting pads may be easily removed from the frame.

A further object of the invention is to provide a peripheral channel formed by the engagement of the top and bottom frame members, the peripheral channel having a slot into which an ornamental band may be inserted.

Yet another object of the invention is to provide an ornamental band having first and second ends so that when the first and second ends of the ornamental band is inserted with the slot of the channel, the ornamental band is mounted and secured within the channel.

A still other object of the present invention is to provide a stackable display apparatus in which the individual pads are effectively retained within the framework but may be easily removed from the frame.

The foregoing features and advantages are generally accomplished by providing a jewelry display and storage apparatus having a top frame member defining an open gridwork, said gridwork being formed of a series of openings. As well, a bottom frame member matingly engageable with the top frame member is provided so that when the top frame member and the bottom frame member are matingly engaged, the top and bottom frame members form a peripheral channel about said perimeter of said frames. As well, the peripheral channel is further provided with a slot.

Additionally, one or more jewelry mounting pads are provided for mounting within the openings. The jewelry mounting pads are provided with a top surface upon which jewelry may be mounted and displayed, a bottom surface and peripheral side walls adapted to be secured within the openings. An ornamental band, having first and second ends, is provided so that when the first and second ends of the ornamental band and inserted within the slot of the channel, the ornamental band is mounted and secured within the channel.

The present invention is also provided with muttually engaged bottom and top frame member having walls dimensioned and arranged to permit identical frame members to be stacked on atop the other, such that jewelry mounted on a mounting pad of a first display apparatus sits within an open bottom chamber of the next stacked apparatus and is completely surrounded by and separated from adjacent jewelry items by walls of the next stacked apparatus.

The top frame member of the jewelry display and storage apparatus is provided with upper and lower surfaces as well as a grooved channel located about the periphery of the lower surface. The bottom frame member also includes a lip portion on the upper surface of the bottom frame member. In this way, when the lower surface of the top frame member and the upper surface of the bottom frame member are matingly engaged, the lip portion is received within the channel and thus form an inter-locking fit.

BRIEF DESCRIPTION OF THE DRAWINGS

The preferred embodiment of the invention will be explained in further detail and in reference to the drawings, in which.

DETAILED DESCRIPTION OF THE PRESENTLY PREFERRED EMBODIMENTS

Figure 1:
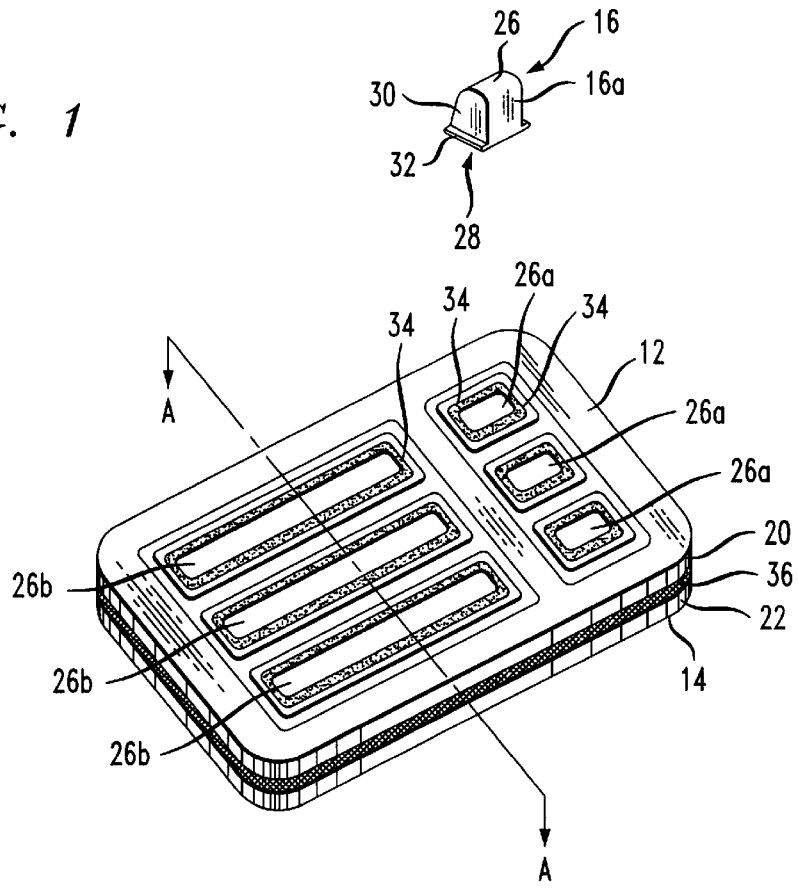
FIG. 1 illustrates a perspective view of the presently preferred embodiment of the display apparatus illustrating the jewelry display pad oriented for insertion into a grid chamber and an ornamental band about the periphery of the apparatus.
Figure 2:
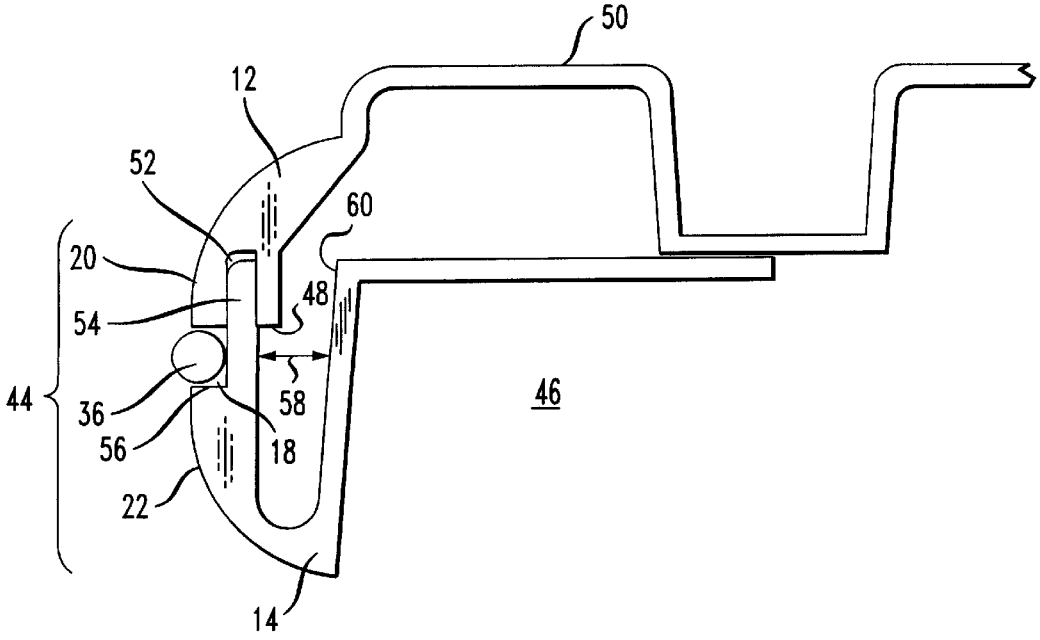
FIG. 2 is a partial exploded elevational cross section taken along lines A—A of FIG. 1 detailing the inter-engagement of the top and bottom frame members along with the ornamental band.

With initial reference to FIG. 1, the jewelry display and storage tray 10 of the present invention is shown in its preferred embodiment. As illustrated, the display tray 10 is comprised of a top frame member 12 and a bottom frame member 14 both of which are fabricated of a plastic material. The top frame member 12 is provided with an open gridwork of openings 26*a*, 26*b* of various dimensions to accommodate one or more pads 16*a* which correspond in dimension to openings 26*a*, 26*b*. For example, depending on the type of jewelry to be displayed, the pads 16 may be either of rectangular shape to accommodate bracelets or pendants or generally square in shape 26*a* to accommodate earrings or rings. As shown in FIG. 2 and as will be described herein, the bottom frame member 14 is matingly engageable with the top frame member 12 so that when the top frame member 12 and the bottom frame member 14 are matingly engaged, the top and bottom frame members 12, 14 form a peripheral channel 18 about the perimeters 20, 22 of the frames 12, 14.

As discussed previously and with reference to FIG. 1, the jewelry display and storage apparatus 10 is also provided with one or more mounting pads 16 for insertion within receiving spaces 26*a*, 26*b* located with the top frame member 12. The jewelry mounting pads 16 are provided with a top surface 26 upon which jewelry (not shown) may be mounted and displayed. The pad 16 is also provided with a bottom surface 28 and peripheral side walls 30 that are adapted to be secured by friction fit or by other suitable inter-engagement means into corresponding openings 26*a* or 26*b*. Optionally, peripheral side walls 30 may be provided with a lipped engagement means 32 which is received into a corresponding slot 34 formed in opening 26*a*.

Figure 3:
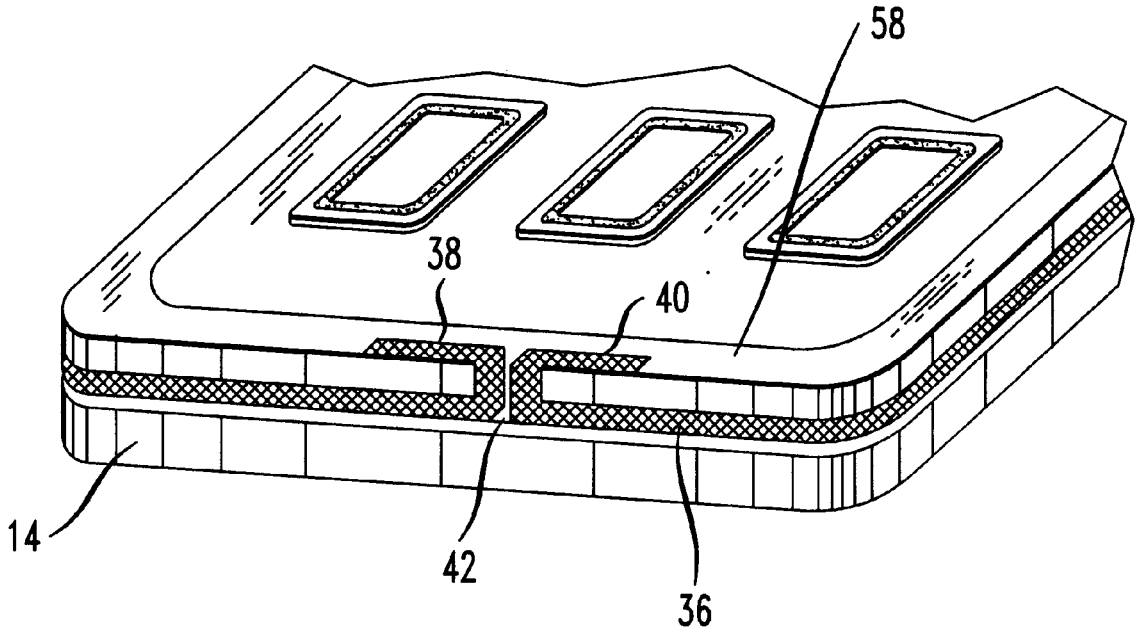
FIG. 3 illustrates is a partial perspective view of the bottom frame member showing the insertion of the first and second ends of the ornamental band in the slot provided in the bottom frame member of the presently preferred embodiment.

As shown in FIGS. 1 and 3, an ornamental band 36 is provided, the ornamental band 36 having first and second ends 38, 40. The first and second ends 38, 40 of the ornamental band 36 are inserted into a slot 42 within peripheral channel 18 so that the ornamental band 36 is positioned along the perimeter 20, 22 of the top and bottom frame members 12, 14. In this way, both ends 38, 40 of the ornamental band 36 are secured to the bottom frame member 14 and thus allows the ornamental band 36 to be secured within channel 18 which is formed between upper and bottom frame members 12, 14. Also as shown in FIGS. 2 and 3, first and second ends 38, 40 of ornamental band 36 are sandwiched in a gap 58 between lip portion 54 and side wall 60. In this way, both ends 38, 40 of ornamental band 36 are securely held in place. Although FIGS. 2 and 3 show the peripheral channel 18 and slot 42 as being formed as part of bottom frame member 14, it is understood that the peripheral channel 18 and slot 42 may be incorporated into the top frame member 12.

With reference to FIG. 2, the jewelry display and storage apparatus 10 may be arranged so that one or more displays 10 may be stacked upon one another. For example, top and bottom frame members 12, 14 form a peripheral wall 44, the peripheral wall 44 being dimensioned and arranged to permit identical frame members to be stacked atop the other, such that the jewelry (not shown) mounted on the mounting pad 16 of a first display apparatus 10 sits within the open bottom chamber 46 of the next stacked apparatus 10. In this way, the jewelry is completely surrounded by and separated from adjacent jewelry items by the walls of the next stacked apparatus.

Also with reference to FIG. 2, the top frame member 12 is provided with upper and lower surfaces 50, 48. The top frame member 12 is also provided with a peripheral grooved channel 52 located about the periphery of the lower surface 48. The bottom frame member 14 has a lip portion 54 on a upper surface 56 of the bottom frame member 14. As such, when the lower surface 48 of the top frame member 12 and the upper surface 56 of the bottom frame member 14 are matingly engaged, the lip portion 54 is received with channel 52.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

What is claimed is:

1. A jewelry display and storage apparatus comprising:

a top frame member provided with upper and lower surfaces, said top frame member comprising a grooved channel located about the periphery of said lower surface, said top frame member further defining an open gridwork, said gridwork being formed of a series of openings;

a bottom frame member provided with upper and lower surfaces, whereby said bottom frame member comprises a lip portion on said upper surface, said bottom frame member further being matingly engageable with said top frame member so that when said top frame member and said bottom frame member are matingly engaged, said lip portion is received within said grooved channel and said top and bottom frame members form a peripheral channel about perimeter of said frame, said peripheral channel further provided with a slot;

a jewelry mounting pad for mounting within said openings, said jewelry mounting pad having a top surface upon which jewelry may be mounted and displayed, a bottom surface and peripheral side walls, said bottom surface and a portion of said peripheral side walls securable within a corresponding opening; and an ornamental band having first and second ends so that when said first and second ends of said ornamental band are inserted within said slot of said peripheral channel, said ornamental band is mounted and secured within said peripheral channel.

2. The jewelry display and storage apparatus of claim 1, wherein said matingly engaged top and bottom frame members are provided with walls, said walls being dimensioned and arranged to permit identical frame members to be stacked one atop the other, such that jewelry mounted on said mounting pad of a first display apparatus sits within an open bottom chamber of the next stacked apparatus and is completely surrounded by and separated from adjacent jewelry items by walls of the next stacked apparatus.

3. The jewelry display and storage apparatus of claim 1, wherein said pad is selectively insertable and removable from said opening within said top frame member.

4. The jewelry display and storage apparatus of claim 1, wherein said top and bottom frame members are made of a plastic material.

5. The jewelry display and storage apparatus of claim 1, wherein said lip and said upper surface of said bottom frame member define a gap therebetween for receiving said first and second ends of said ornamental band.

6. The jewelry display and storage apparatus of claim 1, wherein said bottom frame member further comprises downwardly projecting side walls for elevating said upper surface of said bottom frame member.

7. The jewelry display and storage apparatus of claim 1, wherein the side walls of said jewelry mounting pad are rectangular in shape.

8. The jewelry display and storage apparatus of claim 1, wherein the side walls of said jewelry mounting pad are square in shape.

9. A jewelry display and storage apparatus comprising:

a top frame member provided with upper and lower surfaces, said top frame member comprising a grooved channel located about the periphery of said lower surface, said top frame member further defining an open gridwork, said gridwork being formed of a series of openings;

a bottom frame member provided with upper and lower surfaces, whereby said bottom frame member comprises a lip portion on said upper surface, said bottom frame member further being matingly engageable with said top frame member so that when said top frame member and said bottom frame member are matingly engaged, said lip portion is received within said grooved channel, whereby said grooved channel with said received lip portion define a gap therebetween, said top and bottom frame members further forming a peripheral channel about perimeter of said frame;

a jewelry mounting pad for mounting within said openings, said jewelry mounting pad having a top surface upon which jewelry may be mounted and displayed, a bottom surface and peripheral side walls, said bottom surface and a portion of said peripheral side walls securable within a corresponding opening; and an ornamental band having first and second ends so that when said first and second ends of said ornamental band are inserted within said gap of said grooved channel, said ornamental band is mounted and secured within said peripheral channel.

* * * * *